United States Patent [19]

Messner

[11] Patent Number: 5,062,561

[45] Date of Patent: Nov. 5, 1991

[54] APPARATUS FOR CONTROLLING THE FEED OF AN INTERMITTENT WEB-FEEDING APPARATUS

[75] Inventor: Helmut Messner, Arbon, Switzerland

[73] Assignee: Bruderer Ag, Frasnacht, Switzerland

[21] Appl. No.: 512,749

[22] Filed: Apr. 20, 1990

[51] Int. Cl.[5] ..... B65H 20/00

[52] U.S. Cl. ..... 226/152; 226/158; 475/84; 475/223; 475/243

[58] Field of Search ..... 475/223, 224, 243, 84; 226/142, 143, 154, 158, 152

[56] References Cited

U.S. PATENT DOCUMENTS

| | | | |
|---|---|---|---|
| 1,243,720 | 10/1917 | Eidson et al. | 475/223 |
| 1,388,303 | 8/1921 | Pulliam | 475/223 |
| 1,682,386 | 8/1928 | Lewis | 475/223 |
| 2,152,932 | 4/1939 | Swennes | 74/314 |
| 2,253,535 | 8/1941 | Weinig | 475/224 X |
| 2,753,183 | 7/1956 | Wiig | 271/2.3 |
| 3,758,011 | 9/1973 | Portmann | 226/142 |
| 3,784,075 | 1/1974 | Portmann | 226/143 |
| 4,188,838 | 2/1980 | Nakao et al. | 475/223 |
| 4,555,962 | 12/1985 | Bucarelli | 475/223 X |
| 4,601,217 | 7/1986 | Teraoka et al. | 475/243 X |

FOREIGN PATENT DOCUMENTS 2736366 4/1978 Fed. Rep. of Germany .

*Primary Examiner*—Daniel P. Stodola
*Assistant Examiner*—P. Bowen
*Attorney, Agent, or Firm*—Ladas & Parry

[57] ABSTRACT

The driving gear meshes with the gear on the web of a planetary gear. This planetary gear includes an arrestable sun wheel. The output sun wheel is rigidly connected to the drive shaft. It extends through a sleeve section of the web. A longitudinally displaceable shifting sleeve is located on the sleeve section, which shifting sleeve has a plurality of control disks. These control disks control via a roller the rocking movement of the upper feeding roller. Accordingly, the period of the rocking movement can be selected depending on a respective selected control disk. If the sun wheel is unlocked, the shifting sleeve may be moved such that it engages directly the drive shaft such that by properly selecting the number of teeth it is possible to choose between a rotational speed transmission relation of 1:2 and 1:1.

7 Claims, 1 Drawing Sheet

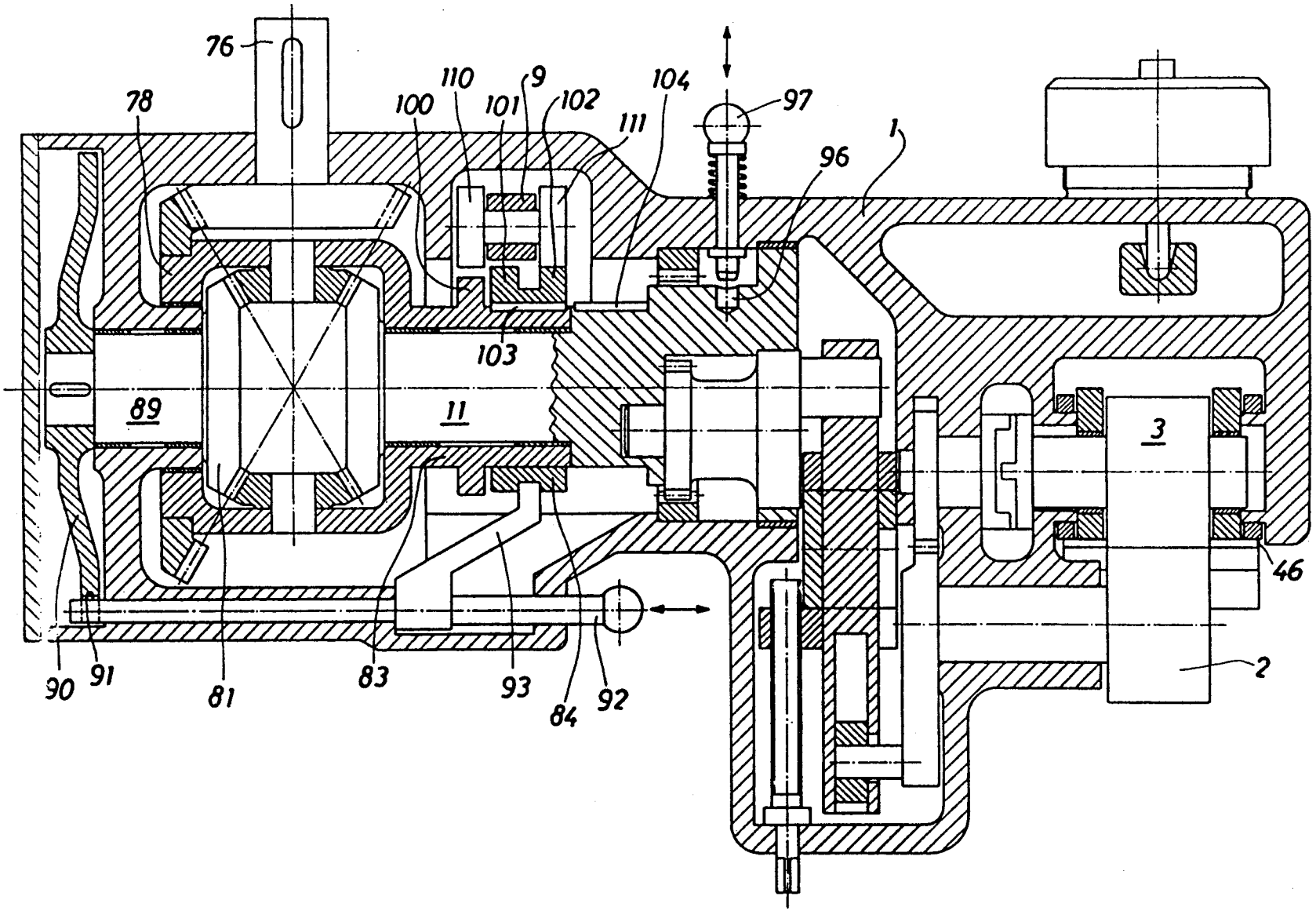
46
2
3
1
96
97
104
111
102
9
101
110
100
103
11
76
78
89
92
84
93
83
81
91
90

APPARATUS FOR CONTROLLING THE FEED OF AN INTERMITTENT WEB-FEEDING APPARATUS

BACKGROUND OF THE INVENTION

1. Field of the Invention

The present invention relates to an apparatus for controlling the feed of a feeding apparatus for intermittently feeding a web-shaped workpiece.

2. DESCRIPTION OF THE PRIOR ART

Apparatuses for intermittently feeding a workpiece is disclosed in U.S. Pat. Nos. 3,758,011 and 3,784,075. In these a selected, predetermined relationship between the rotational speed of the driving shaft and the phase of oscillation is present. These known apparatuses do not allow changing this relationship after it has been initially set, at least without large expenditures.

SUMMARY OF THE INVENTION

It is thus a general object of the present invention to provide an apparatus, by means of which the stroke of the feed can be adjusted directly.

A further object of the present invention is to provide such an apparatus which comprises a planetary gear having a web including a toothed rim that meshes with a driving gear wheel, which web supports planet pinions, which mesh on the one hand with an arrestable sun wheel and on the other hand with an output sun wheel seated on a shaft which is rotatably supported in an axial sleeve section of said web and coupled to an eccentric member of a transmitting unit operative to transform the rotational movement of the shaft of the output sun wheel into an oscillating movement for a driving of said feeding apparatus.

BRIEF DESCRIPTION OF THE DRAWING

The present invention will be better understood and objects other than those set forth above will become apparent when consideration is given to the following detailed description thereof. Such description makes reference to the annexed drawing, wherein:

FIG. 1 is a sectional view of a feeding apparatus.

DESCRIPTION OF A PREFERRED EMBODIMENT

The basic design and function of this apparatus is extensively described and disclosed in the Swiss patent application No. 3983/88-0 and the disclosure made therein is expressly referred to hereafter. Reference is made hereby specifically to FIG. 6 and the corresponding disclosure of the mentioned application.

FIG. 1 illustrates now a further embodiment of the apparatus for shifting or controlling the feed, which in general is the same as the embodiment in accordance with FIG. 6 of the application referred to above. Accordingly, the description here of this further embodiment uses the same reference numerals as the application referred to above and refers only to the decisive structural differences.

A shifting sleeve 84 is mounted on a sleeve section 83 to rotate therewith, but to be axially displaceable. This shifting sleeve 84 supports a plurality of control disks (i.e. eccentrics or cams) 101, 102, having an operative function that corresponds to that of the cam member 12 of FIG. 1 of the application referred to above. A further control disk 100 is fixedly mounted to the sleeve section 83, i.e. integrally formed therewith. These control disks 100, 101, 102 control the movement of the rollers 110 and 111, which are coupled via a lever 9 to a link rod for moving a rocker (4 in the application referred to above). As can be clearly seen, the roller 110 cooperates exclusively with the control disk 100, whereas the roller 111 cooperates either with the control disk 101 or the control disk 102. For the latter, a control slide bar 92 includes a dog 93 that projects into an interstice between the control disks 101 and 102. Accordingly, the shifting sleeve 84 can be displaced back and forth on the sleeve section 83 by operating the control slide bar 92 to select the one of the control disks 101, 102 on which the roller 111 shall rest.

The shifting sleeve 84 includes, furthermore, tooth-shaped coupling members 103, which engage tooth-shaped coupling members 104 on the drive shaft 11 when the shifting sleeve is moved to the right from the position shown in FIG. 1. The drive shaft comprises, further, at the section thereof forming the eccentric member, a recess 96, into which an arresting member 97 can be inserted by longitudinal movement in the casing 1.

Below, the operation of this embodiment of the control apparatus will be described. The description proceeds from the position of the various control elements as illustrated in FIG. 1. The structure of the planetary gear is identical to that of FIG. 6 of the application referred to above and has been disclosed therein such that there is no need for describing such in detail.

In contrast, however, the rocker is controlled by two control disks, namely the control disks 100 and 101 or the control disks 100 and 102, via the rollers 110 and 111 cooperating therewith, and in accordance with the operation of these cooperating members, the upwards and downwards movement of the pressing bar 46 and pressing and feeding roller 3 is timed. The control disk 100 and roller 110 controls thereby the phase of the intermediate lifting of the pressing bar 46, during which time span a workpiece to be worked is not held and centred by the pressing bar but rather by the arresting members of the tool acting on the workpiece, as is well known in the art. The two control disks 101 and 102, which cooperate with the roller 111, determine the adjustable feed, i.e. the feeding phase of the feeding apparatus.

When the control slide bar 92 is shifted completely to the left, as shown in the figure, its front end engages arrestingly the arresting disk 90 of the arrestable sun wheel 81 and the roller 111 runs on the control disk 102. As has already been mentioned, the roller 110 cooperates continuously with the control disk 100. Due to the arrested sun wheel 81, a preset gear ratio 1:2 prevails between a web 78 of sleeve section 83 and the drive shaft 11 and the control disk 101 can be in such a rotational position relative to the sleeve section 83 that resting of the pressing and feeding roller on a web to be fed occurs only during 90° and, for instance, relative to the phase, symmetrically at a punching movement of a punch press.

If the control slide bar 92 is adjusted towards the right (based on the figure), the roller 111 cooperates instead with the control disk 101. The roller 110 cooperates still and continuously with the control disk 100, but now, the front end of the control slide bar 92 also clears the arresting disk 90 and, accordingly, the arrestable such wheel 81 is free to turn. However, the coupling members 103, i.e. the toothing of the shifting sleeve 84, now engage the coupling members 104, i.e. the toothing on the drive shaft 11, for a rotationally fixed engagement.

The planetary gear then operates exactly as has been described with reference to FIG. 6 of the application referred to above, whereby now a ratio of 1:1 is attained. Accordingly, the upper pressing and feeding roller 3 lies on the web to be fed during a phase of 180° of the rotational movement of the drive shaft. A direct drive transmission prevails.

The position of the phase of the intermediate lifting can be adjusted relative to the feeding phase, as determined by the control disks 101, 102, by the control disk 100. To this end, when the shifting sleeve 84 is moved completely towards the right such that its coupling members 103 mesh with the coupling members 104 of the drive shaft 11, the arresting member 97 is inserted into the recess 96 of the drive shaft 11 to arrest the latter. The sleeve section 83 can now be rotated on the drive shaft 11. (This can proceed via a controlled rotational movement of the drive shaft 76.) If the sleeve section 83 is rotated on the drive shaft 11, the control disk 100 obviously follows this rotational movement such that it is rotated relative to the control disks 101 and 102 Thus, an adjustment of the phases of the intermediate lifting and the feeding is arrived at. After this adjustment of the phases has been made by the relative rotation of the control disk 100, the shifting sleeve 84 is again moved towards the left, such that its toothing 103 engages into the toothing of the drive shaft 11 at a compared with the previous different position. Thereafter the arresting member 97 is pulled out the recess 96 such that the drive shaft 11 is again released. By means of this design it is accordingly possible to adjust the feeding phase relative to the phase of the intermediate lifting of the feeding apparatus by an extremely simple procedure such that it is possible to adjust the feeding apparatus within a wide range for a large variety of operations to be made on a sheet metal web, e.g. in a punch press.

While there is shown and illustrated a present preferred embodiment of the invention, it is to be distinctly understood that the invention is not limited thereto, but may be otherwise variously embodied and practiced within the scope of the following claims.

I claim:

1. In an apparatus for controlling the feed of a feeding apparatus for intermittently feeding a web-shaped workpiece, the apparatus having a rotationally driven web with a sleeve section, a planetary gear having planet gears pinioned on the web and sun wheels, a drive shaft rotatably supported in the sleeve section of the web and coupled for rotation with one of the sun wheels, feeding means having a pressing and feeding roller rotated by the rotation of the drive shaft and rockable for intermittently feeding the web-shaped workpiece when rocked into engagement therewith, holding means having a pressing bar rockable into intermittent engagement with the web-shaped workpiece for holding it, and rocking means operated by the rotation of the drive shaft for rocking the feeding and holding means, the improvement of the rocking means, comprising:

a plurality of control disks on a shifting sleeve arranged rotationally fixed but axially displaceable on the sleeve section of the web and a further control disk fixedly mounted to the sleeve section of the web to control the rocking means for the feeding and holding means.

2. The apparatus of claim 1;

wherein the plurality of control disks control the rocking means for the feeding means and the further control disk controls the rocking means for the holding means.

3. The apparatus of claim 2;

wherein the plurality of control disks are axially spaced along the shifting sleeve and the rocking means for the feeding means is controlled by one of the plurality of control disks at a time; and further comprising slide bar means for axially displacing the shifting sleeve on the sleeve section for selecting the one of the plurality of control disks that controls the rocking means for the feeding means at that time.

4. The apparatus of claim 3;

wherein another of the sun wheels is connected to an arresting disk for rotation together; and wherein the slide bar means has a front end for engaging and arresting rotation of the arresting disk only when the slide bar has axially displaced the shifting sleeve for control of the rocking means by a first one of the plurality of control disks, whereby to change the ratio of the planetary gear between the web and the drive shaft.

5. The apparatus of claim 4, and further comprising:

arresting means for arresting rotation of the drive shaft; and coupling means for then coupling the shifting sleeve to the drive shaft for arresting rotation therewith.

whereby to change the phases of the plurality of control disks relative to the further control disk.

6. The apparatus of claim 3, and further comprising:

arresting means for arresting rotation of the drive shaft; and coupling means for then coupling the shifting sleeve to the drive shaft for arrested rotation therewith, whereby to change the phases of the plurality of control disks relative to the further control disk.

7. The apparatus of claim 2, and further comprising:

arresting means for arresting rotation of the drive shaft; and coupling means for then coupling the shifting sleeve to the drive shaft for arrested rotation therewith, whereby to change the phases of the plurality of control disks relative to the further control disk.

* * * * *

UNITED STATES PATENT AND TRADEMARK OFFICE

CERTIFICATE OF CORRECTION

PATENT NO. : 5,062,561

DATED : November 5, 1991

INVENTOR(S) : Helmut Messner

It is certified that error appears in the above-identified patent and that said Letters Patent is hereby corrected as shown below:

On title page,

Before "[51]" insert -- [30] Foreign Application

Priority Data May 3, 1989 [CH] Switzerland 1692/89-7 --

Signed and Sealed this

Thirtieth Day of March, 1993

*Attest:*

STEPHEN G. KUNIN

*Attesting Officer*

*Acting Commissioner of Patents and Trademarks*